United States Patent [19]

Gans

[11] 3,971,608

[45] July 27, 1976

[54] KNOCK-DOWN DRAWER UNIT

[76] Inventor: Charles C. Gans, 240 E. 35th St., New York, N.Y. 10016

[22] Filed: Apr. 17, 1975

[21] Appl. No.: 568,968

[52] U.S. Cl. ..... 312/257 R; 312/330 SM

[51] Int. Cl.[2] ..... A47B 43/00

[58] Field of Search ..... 312/257, 330, 263, 339; 249/205; 297/218, 219; 24/204; 52/483

[56] References Cited

UNITED STATES PATENTS

| | | | |
|---|---|---|---|
| 3,295,474 | 1/1967 | Ornstein | 248/205 A X |
| 3,403,641 | 10/1968 | Baker | 312/263 X |
| 3,488,097 | 1/1970 | Fall | 312/339 X |
| 3,566,556 | 3/1971 | Nichols | 24/204 |
| 3,777,435 | 12/1973 | Perina | 24/204 |
| 3,848,942 | 11/1974 | Fanini | 312/263 |
| 3,863,412 | 2/1975 | Bodycomb | 52/483 |

*Primary Examiner*—Roy D. Frazier
*Assistant Examiner*—Peter A. Aschenbrenner
*Attorney, Agent, or Firm*—Caesar, Rivise, Bernstein & Cohen, Ltd.

[57] ABSTRACT

A Knock-Down Drawer Unit including at least one drawer and a frame, said frame supporting the drawer therein and comprising a vertical said wall, a vertical back wall and a horizontal top wall. The walls are connected to each other at respective freely detachable joints. The joints are held securely together via the use of a detachable, two-component fastening tape, such as VELCRO. Mounting means are provided for supporting a slide assembly on the top wall. The slide assembly serves to slidably support the drawer in the frame. The mounting means comprises a support member permanently secured to the side wall and a detachable, two-component fastening tape, such as VELCRO, with one component of the fastening tape being permanently secured to the support member and the other component of the tape being permanently secured to said slide assembly.

8 Claims, 9 Drawing Figures

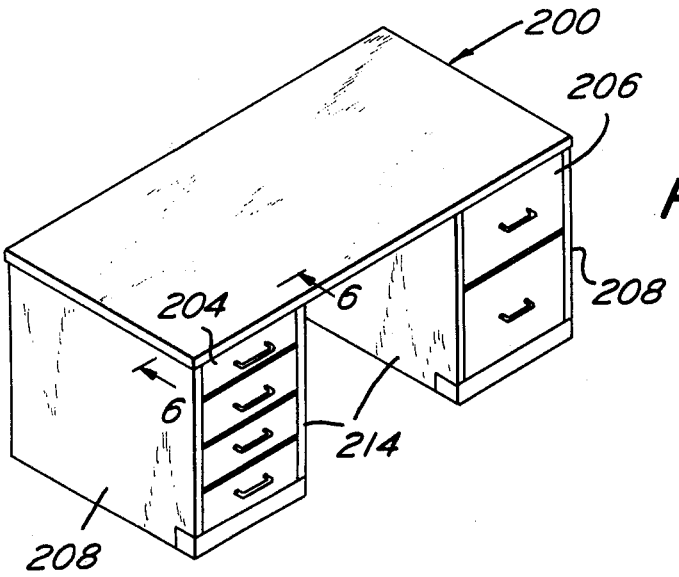
FIG.4
FIG.6
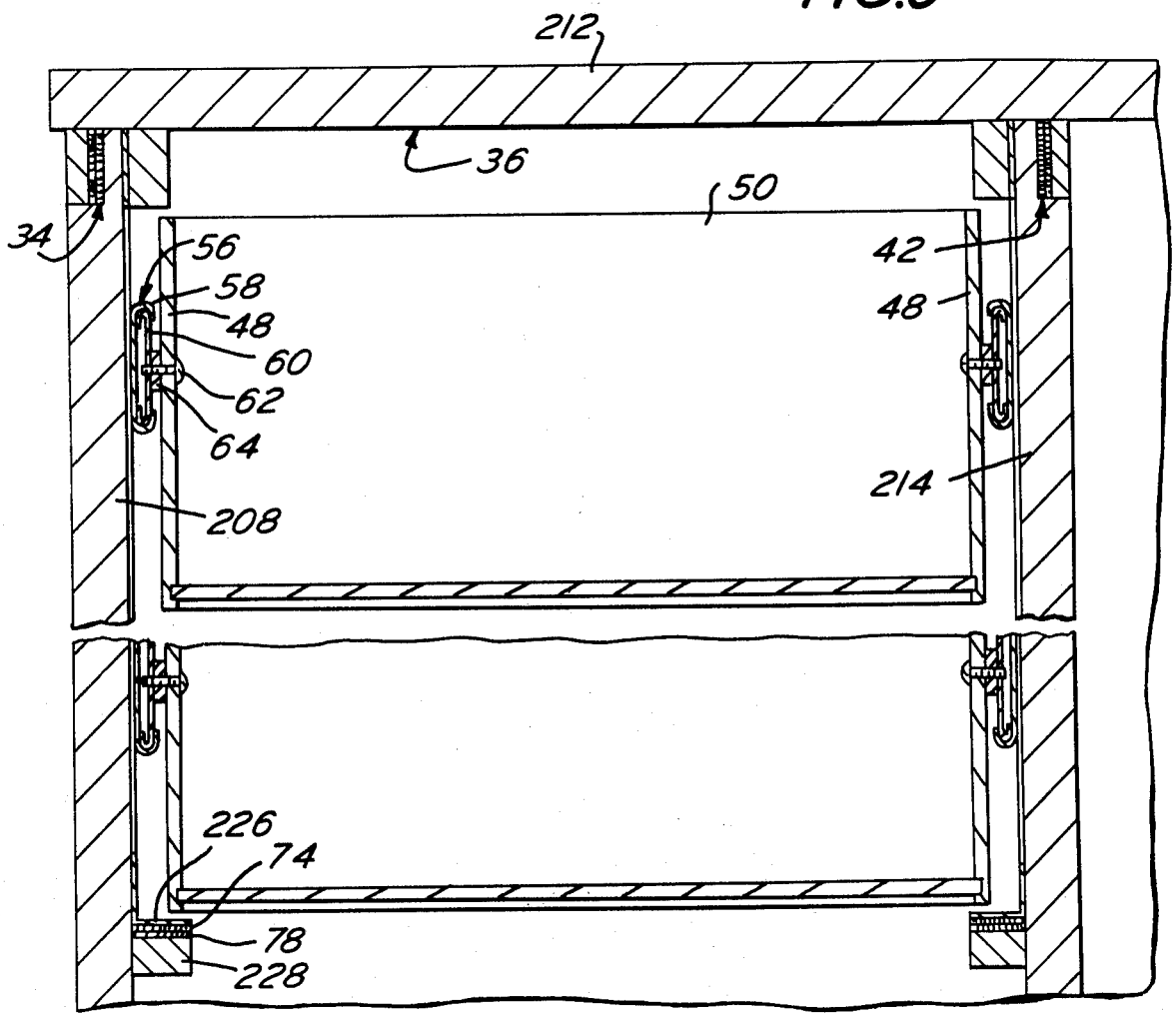

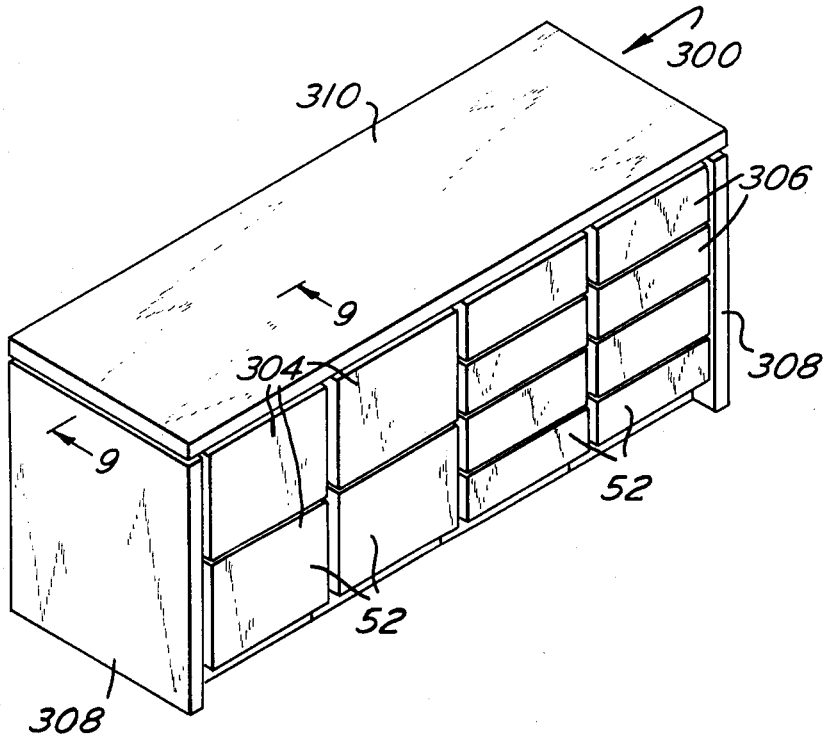
FIG. 7
FIG. 9
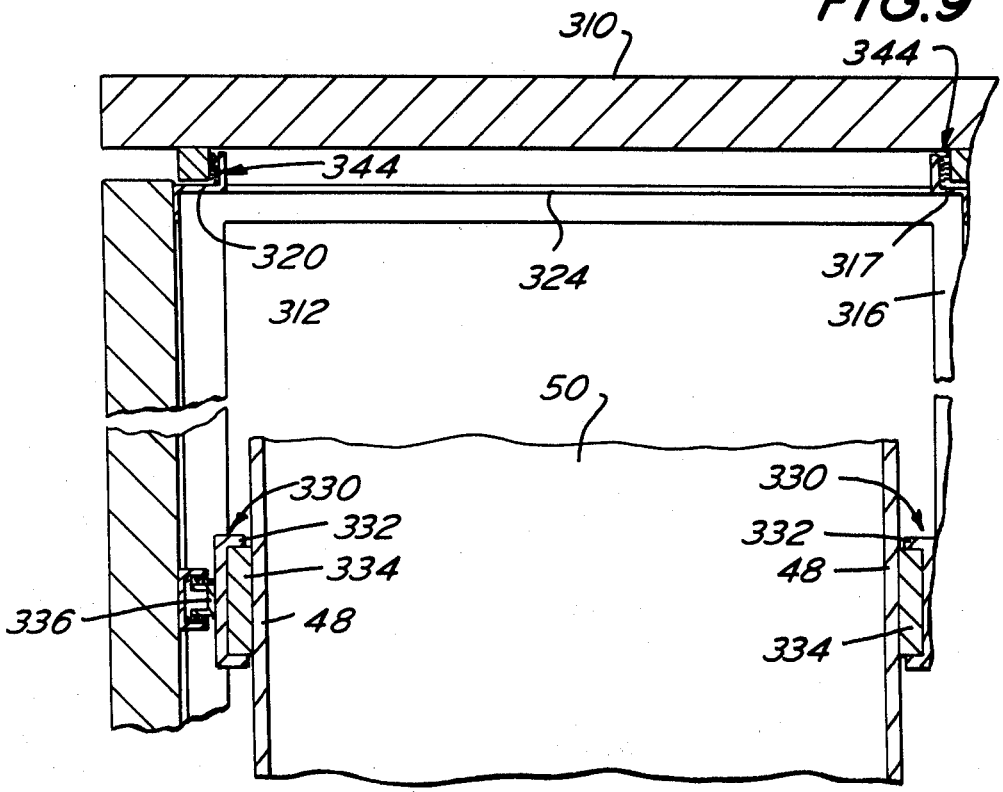

KNOCK-DOWN DRAWER UNIT

This invention relates generally to furniture and more particularly to knock-down drawer supporting devices.

Due to various economic factors and the increased mobility of people in today's industrialized society, a deep need has developed and presently exists for furniture which can be manufactured, transported and assembled inexpensively, quickly and easily. To that end, various types of knock-down furniture have been proposed and are available.

As is known, knock-down furniture is a designation for a type of furniture construction wherein the furniture is shipped from the factory in a disassembled state and is arranged to be readily assembled by the user without the need for any special effort or skill.

While occasional furniture, such as, chairs, small tables, etc., are frequently designed and have found substantial commerical acceptance utilizing knock-down construction techniques, large pieces of furniture utilizing such techniques have not heretofore met with any widespread commercial acceptance. The reasons for the failure to gain such acceptance is primarily based upon esthetic considerations since knock-down furniture in order to be simple enough to enable the ready assemblage and disassemblage thereof, invariably gives a flimsy or temporarily constructed look and not the finished and integral look of conventionally constructed furniture.

In my co-pending U.S. Pat. application Ser. No. 529,708, now U.S. Pat. No. 3,929,375 filed on Nov. 4, 1974, there is disclosed and claimed a knock-down seating device which overcomes many of the disadvantages of the prior art and is low in cost, can be readily assembled and disassembled and once assembled has the look of conventionally assembled furniture. To that end, the seating device comprises a frame including a base supporting at least one cushion thereon, a pair of side walls and a back wall. The back wall is connected to each side wall at a freely detachable tongue and groove joint. The joint is held securely together via the use of detachable, two-component fastening tape, such as VELCRO. One portion of the base component of the tape is located within a recess in the side wall and a second and separate portion of the base component of the tape is located in the recess in the back wall which is contiguous with the recess in the side wall. The top component of the tape bridges the two portions of the bottom component and is detachably fastened thereto to effect the securement of the joint. A decorative cover is provided over the outer surface of the top component of the tape.

It is a general object of this invention to provide knock-down drawer-supporting furniture which can be readily assembled and disassembled, is low in cost and which, once assembled has the look of conventionally assembled furniture.

It is a further object of this invention to provide knock-down drawer-supporting furniture which is extremely sturdy in construction and which is held together by extremely simple connection means.

It is still a further object of this invention to provide knock-down drawer-supporting furniture including freely detachable slide assemblies for supporting drawers therein.

These and other objects of this invention are achieved by providing a knock-down drawer unit comprising at least one drawer, and a frame for supporting the drawer therein. The frame comprises a vertical side wall and a top wall. The side wall includes mounting means supporting the slide assembly thereon. The slide assembly slidably supports the drawer within the frame. The side wall and the top wall are connected to each other by a freely detachable joint. The joint is secured together by releasable fastening tape.

Other objects and many of the attendant advantages of this invention will be readily appreciated as the same becomes better understood by reference to the following detailed description when considered in connection with the accompanying drawing wherein:

FIG. 4 is a perspective view of a knock-down desk-drawer unit in accordance with this invention;

FIG. 6 is an enlarged sectional view taken along line 6—6 of FIG. 4;

FIG. 7 is a perspective view a knock-down credenza unit in accordance with another aspect of this invention;

FIG. 9 is an enlarged sectional view taken along line 9—9 of FIG. 1.

Figure 1:
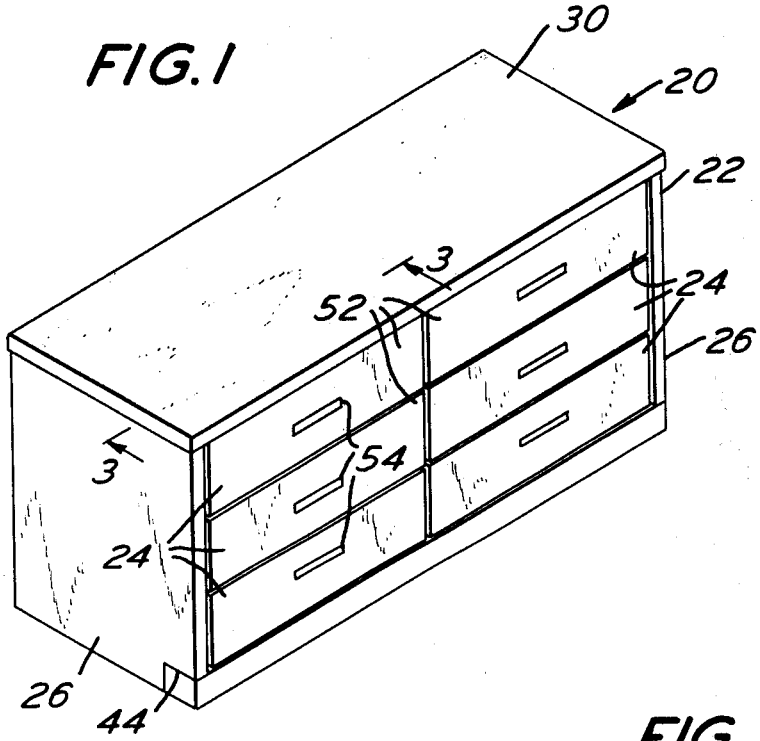
FIG. 1 is a perspective view of a knock-down drawer unit in accordance with this invention.

Referring now to the various figures of the drawing wherein like reference characters refer to like parts, there is shown in FIG. 1 a drawer unit 20 constructed in accordance with this invention. The unit 20 is of a knock-down construction for ready assemblage, disassemblage and transportation and basically comprises a frame 22 for supporting a plurality of slidable drawers 24 therein.

Figure 3:
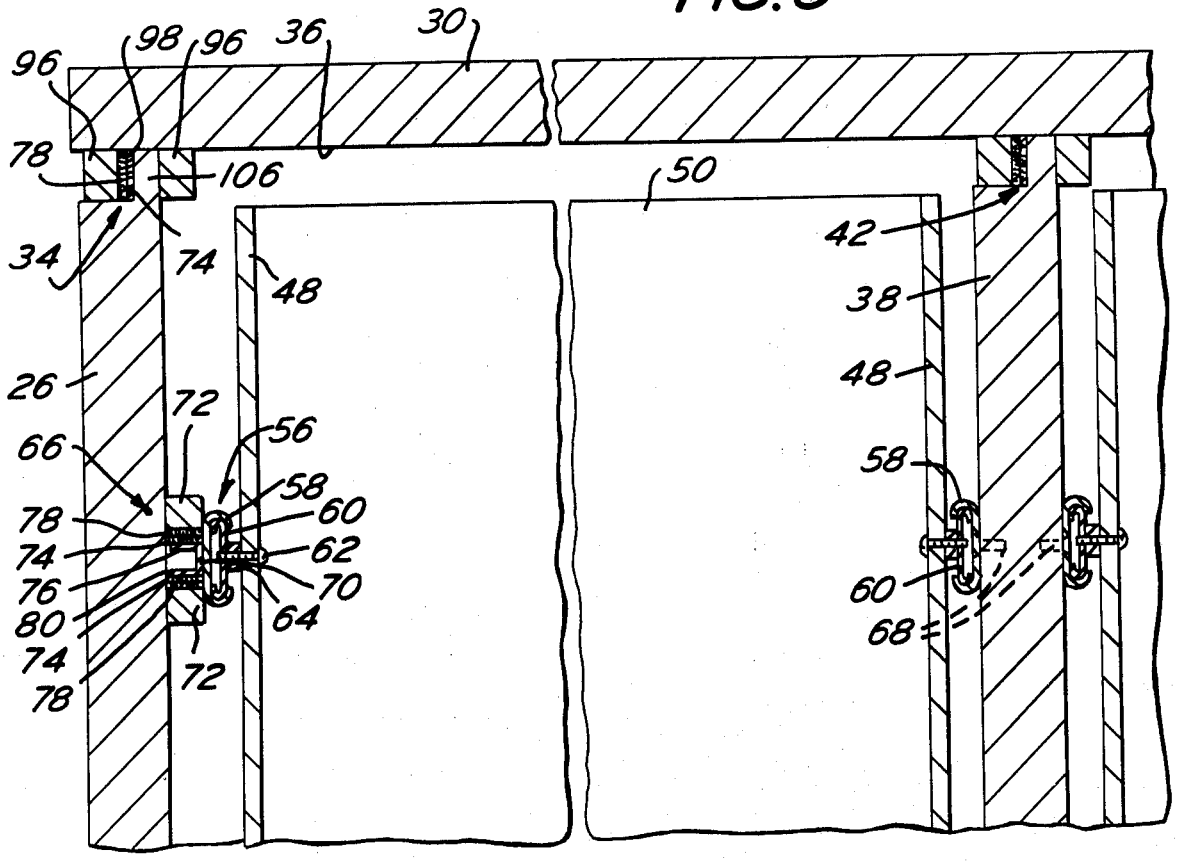
FIG. 3 is an enlarged sectional view taken along line 3—3 of FIG. 1.
Figure 2:
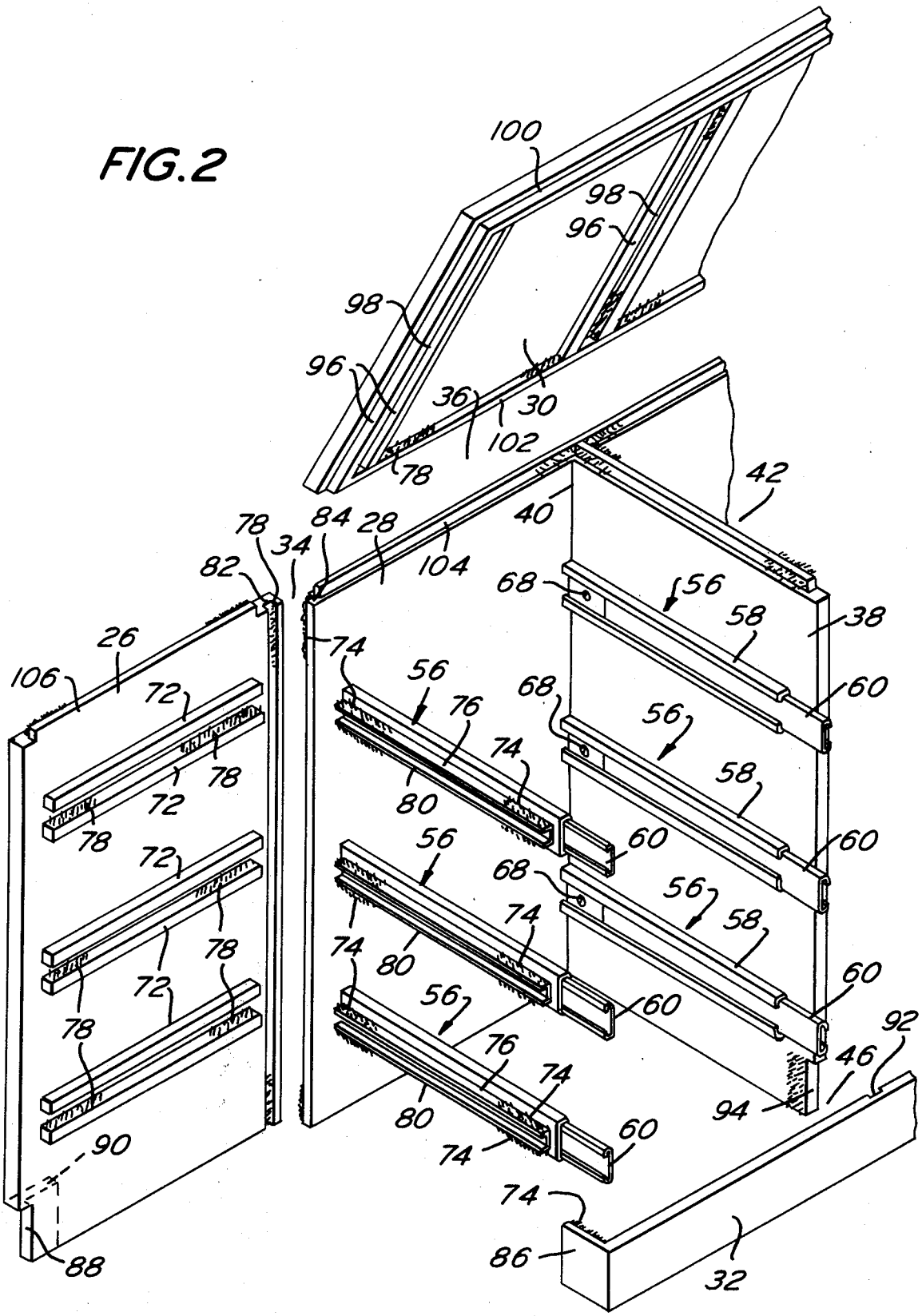
FIG. 2 is an enlarged exploded perspective view of a portion of the drawer unit shown in FIG. 1.

As can be seen in FIGS. 1 and 2 the frame basically comprises a pair of opposed, verically oriented, rectangularly shaped planar side walls 26, a vertically oriented, rectangularly shaped planar back wall 28, a rectangularly shaped, horizontally oriented, planar top wall 30 and an elongated front base wall 32. The back edge of side wall 26 is connected to a side edge of back wall 28 at a freely detachable joint 34 (FIG. 3). The top edge of the back wall 28 is connected to the rear edge of the top wall 30 by a freely detachable joint 36 (FIG. 3).

As will be described later, each side wall 26 is arranged to support the outside of the group of drawers 24 associated therewith. In order to support the inside of each of the drawers, a center divider 38, in the form of a rectangularly shaped, planar wall, is provided. The center divider extends normally to the plane of the back wall and is connected thereto at a tongue and groove joint 40. The top edge of the divider wall 38 is connected to a mid portion of top wall 30 by a freely detachable joint 42 (FIG. 3).

The front base wall is connected at each end thereof to the lowermost portion of the front edge of each of the side walls 26 by a freely detachable joint 44 (FIG. 1). The central portion of the front base wall is connected to the lowermost portion of the front edge of the divider wall 38 by a freely detachable joint 46.

In accordance with the preferred embodiment of this invention, the joints are tightly secured together by readily detachable tape fastening means, such as VELCRO tape, manufactured by the Velcro Manufacturing Company of Manchester, New Hampshire. The details of each of the joints 34, 36, 40, 42, 44 and 46, as well as the detachable fastening tape means securing such joints will be described in detail later.

As can be seen in FIGS. 1 and 3, each of the drawers is of a conventional type and includes a pair of side walls 48, a back wall 50, a front wall 52 and a base wall (not shown). A handle 54 is secured to the front wall 50 of the drawer to provide the means for extending the drawer out of the frame in a conventional manner.

In the embodiment of the unit 20, shown in FIG. 1, slide assemblies, denoted by the reference numeral 56, are provided as the means for enabling the drawers to be extended are retracted smoothly. Preferably the assemblies are of the "Grant" type and each includes channel member 58 and an elongated slide 60. The channel 58 is an elongated metal member defining a track-like recess therein and in which the slide 60 is disposed. The slide 60 is adapted to be slid longitudinally along the track formed by the channel member 58.

As can be seen in FIG. 3, each side wall 48 of drawer 24 is connected to a respective slide 60 of a slide assembly 56 via plural threaded fastening means, such as screws 62. A spacer or washer 64 is disposed about the shank portion of the screw 62 and between the outer edge of the side wall 48 of the drawer and the slide 60 to space the slide from the drawer's side wall.

The channel member 58 of each slide assembly 56 which is associated with the frame's side wall 26 is mounted thereon via support means designated by the reference numeral 66. The channel members 58 of the slide assemblies 56 associated with the divider wall 38 are mounted thereon via threaded fastening means 68 in the form of counter-sunk screws.

The channel member 58 of the slide assembly 56 associated with the side wall 26 includes an elongated support channel bar 70 permanently secured thereto and extending along the full length of channel 58. The support channel bar 70 is mounted on and is detachably secured to the support means 66. The support means 66 comprises a pair of elongated cleats 72 which are permanently secured to the inside face of side wall 26 and are disposed horizontally and spaced apart from each other. The space between the cleats 72 serves to receive the support channel bar 70 therein.

The means for securing the support bar 70 and its associated slide assembly 56 to the support means 66 on the side wall 26 comprises readily detachable VELCRO tape fastening means. As is known, such tape means consists of two separable strips. One componenet strip has a back surface and a front surface having a large plurality of loop-like elements thereon and the other component strip has a front surface and a back surface having a large plurality of hook-like elements thereon. The strips are adapted to be secured to each other by the coaction of the hook-like elements and the loop-like elements. To that end, the strips are abutted, such that the hook-like elements contact and intertwine the loop-like elements to effect the securement between the two strips. The resulting securement between the strips is very firm, yet the strips can be readily detached by pulling one off the other.

In order to effect the securement of the slide assembly 56 to support means 66 strips of one component of the tape, denoted by the reference numeral 74 are permanently secured to the top surface 76 of the flange member 70 adjacent its ends. Strips of the other component of the fastening tape, denoted by the reference numeral 78 are permanently secured to the underside of the upper cleat 72 adjacent its ends. In a similar manner strips of one component 74 of the fastening tape are permanently secured to the bottom surface 80 of channel member 70 while strips of the other component 78 of the tape are permanently secured to the upper surface of the lower cleat 72.

As should thus be appreciated, the opposed cleats 72 support the slide assembly on the wall and hence support the weight of the drawer thereon. The readily detachable fastening means enables each slide assembly 56 to be readily and easily connected to the side wall 26 without the need for tools or conventional fastening means.

As can be seen in FIG. 2, the joint 34 is a modified tongue and groove joint. To that end, a respective elongated groove 82 is provided in the inside faces of side wall 26 and extending closely along and parallel to the back of the side wall the full height thereof. A tongue 84 projects from the outside edge of back wall 28 and extends along the full height thereof. The tongue 84 is adapted to mate with groove 82 to effect the connection of the side wall 26 to the back wall 28. In order to secure the tongue 84 within groove 82 additional strips of readily disconnectable tape securement means like that utilized for securing the slide assemblies to the support means are utilized. To that end, strips of one component 74 of the detachable tape fastening means are permanently secured to the inside face of the tongue 84 and strips of the other component of the tape fastening means are secured to the associated and abutting wall of the groove 82. As can be seen in FIG. 2, the tape fastening means is provided adjacent the upper end and the lower end of the joint and need not extend the full length therealong.

Each end of the base portion 32 of the frame includes a short projecting flange 86. The flange 86 serves as one component of the joint 44. A notch 88 is provided in the front edge of the side wall 26 at the bottom thereof and a recess 90 is provided in the outside surface of the side wall 26 contiguous with notch 88. Recess 90 is configured to receive in mating engagement flange 86 with the portion of the front base wall 32 contiguous with flange 86 disposed within notch 88 to thereby form joint 44. As with joint 34, readily detachable tape fastening means is provided to effect the securement of the joint 44. To that end, strips of one component 74 of the tape are permanently secured to the inside face of flange 86 and strips of the other component 78 of the tape are permanently secured within recess 90.

As can be seen in FIG. 2, the mid portion of joint 46 is also of the tongue and groove type is formed by a vertically extending groove 92 in the inside face of base member 32. A notch 94 is provided in the lowermost portion of the outside edge of the divider wall 38 with the wall portion contiguous therewith adapted to be received within groove 92. Joint 46 also includes readily detachable fastening tape means to secure it together. To that end, strips of one component of the fastening tape are permanently secured within groove 92 while strips of the other component of the fastening tape are permanently secured to the divider 38 contiguous with notch 94.

As noted heretofore, the top wall 30 is connected to the side wall 26, back wall 28 and divider wall 30, via joints 34, 36 and 42, respectively. Each of the joints is of the tongue and groove type and is constructed and arranged in a similar manner to the others.

As can be seen in FIG. 2, the underside of top wall 30 includes plural pairs of elongated members secured to the bottom edge and extending parallel to one another from front to back. One such pair of members is denoted by the reference numeral 96 and defines a groove 98 therebetween. The members 96 are disposed adjacent the side edge of top wall 30 to serve as a portion of the joint 34. Similar elongated members are provided along the bottom surface of the top wall 30 along the opposite edge to form a portion of the joint 34 between the top wall and that side wall. A similar pair of elongated members are provided on the bottom surface of top wall 30 extending from the near edge to the front edge in the mid portion of the top wall 30 to define a groove 98 therebetween, which groove serves as one component of the joint 42 between the top wall and the divider 38. An elongated member 100 extends along the bottom surface of the top wall 30 closely adjacent to the front edge thereof while a similar member 102 is provided on the bottom surface of the top wall 30 and extending along the back edge thereof. The member 102 serves as one component of the joint 36, with the other component thereof being formed by a lip 104 extending along the top edge of the back wall 28.

As can be seen in FIG. 2, joint 34 is of the tongue and groove type wherein space 98 between members 96 on the bottom surface of top wall 30 serves as the groove and wherein a lip 106 extending along the top edge of the side wall 26 serves as the tongue. Readily detachable tape fastening means are provided to secure the tongue 106 within groove 98 of joint 34. To that end, strips of one component 74 of the fastening means are permanently secured to the inside face of tongue 106 and strips of the other component 78 of the tape fastening means are permanently secured to the inside face of the outer member 96.

The top edge of divider 38 includes a lip 108 which forms the tongue to be disposed within groove 98 to form joint 42. Joine 42 is secured together via readily detachable tape fastening means in the same manner as joint 34.

The lip 104 on the back wall 28 is adapted to abut member 102 on the bottom surface of top wall 30 along the back edge thereof to form joint 36. Joint 36 is secured together via releasable fastening tape. To that end, strips of one component (not shown) of the tape fastening means are permanently secured to the back surface of lip 104 and strips of the other component 78 of the tape fastening means are permanently secured to the inside face of member 102.

As should be appreciated from the foregoing use of VELCRO tape to effect the securement of the frame together and to effect the securement of the slide assemblies on the frame enables such securement to be effected rapidly without the use of any tools or special techniques. In addition, by virtue of the releasability of the components of the tape, the components of the drawer unit can be disassembled easily. This feature is of considerable importance when it is desired to move or transport the unit.

Figure 5:
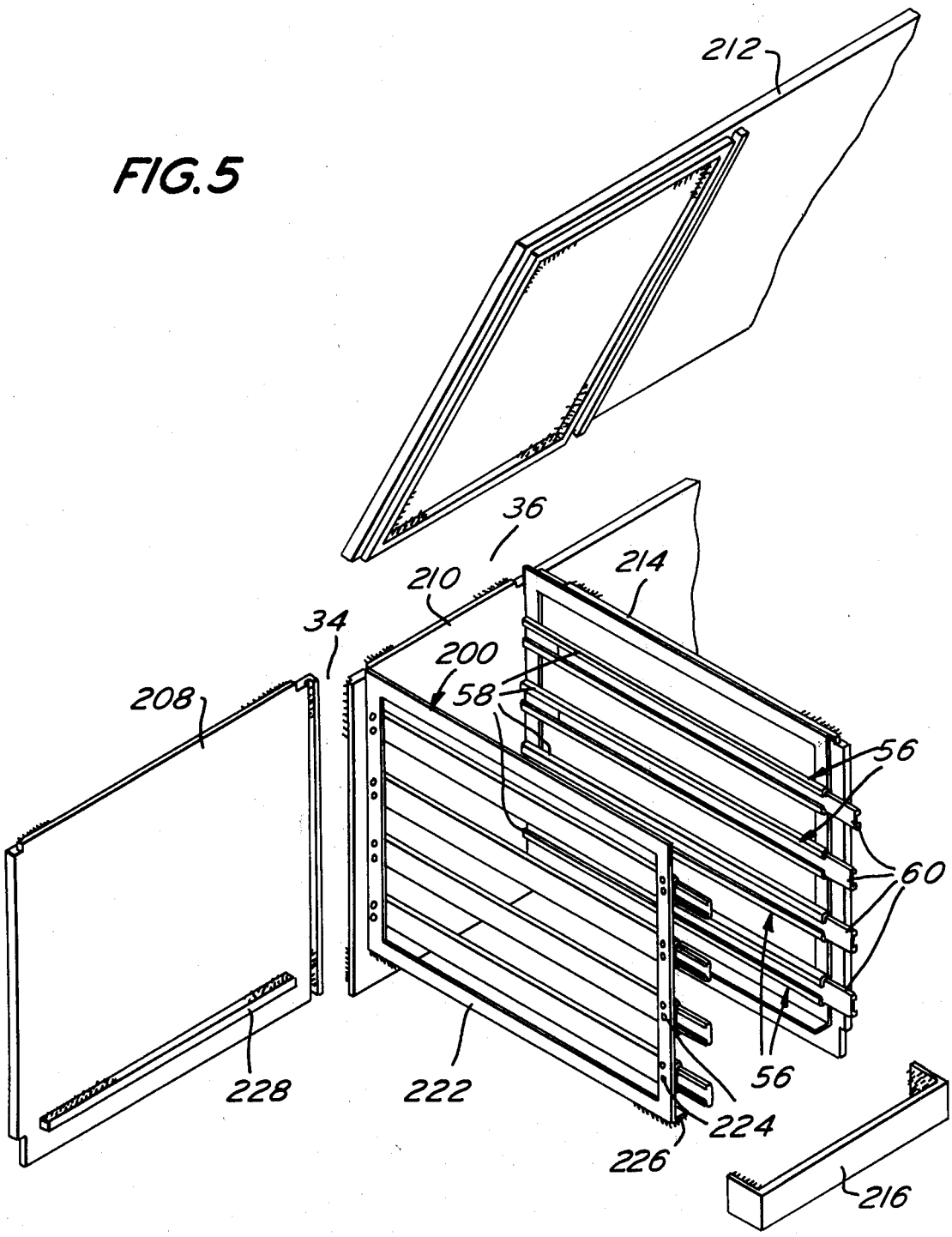
FIG. 5 is an enlarged exploded perspective view of the desk shown in FIG. 4.

In FIG. 4 there is shown a different type of drawer furniture, that being a drawer-desk unit 200. The unit 200 is of a knock-down construction and basically comprises a frame 202 for supporting a plurality of slidable drawers 204 and 206 therein, with the drawers 204 being disposed on one side of the unit and the larger drawers 206 being disposed on the other side thereof. As can be seen in FIGS. 4 and 5, the frame basically comprises a pair of opposed, vertically oriented, rectangularly shaped, planar outside walls 208, a vertically oriented, rectangularly shaped, planar back wall 210, a rectangularly shaped, horizontally oriented, planar top wall 212, a pair of opposed, vertically oriented, rectangularly shaped, planar inside walls 214 and a pair of elongated front base walls 216.

Like in the unit 20, described heretofore, the back edge of the side wall 208 is connected to the side edge of the wall 210 at a freely detachable joint 34 (FIG. 5). The top edge of the back wall 210 is connected to the rear edge of the top wall 212 by a freely detachable joint 36 (FIG. 6).

The back edge of each inside wall 214 is connected to an intermediate portion on the back wall 210 at a joint 40. The top edge of each inside wall 214 is connected to a respective mid portion of the top wall 212 by a freely detachable joint 42. The front base wall 206 is connected to the outside wall 208 at a freely detachable joint 44 and is connected to the inside wall 214 at another freely detachable joint 44 (FIG. 4). Each of the joints 34, 36, 42 and 44 is constructed in a similar manner as the corresponding joints of the unit 20 and are secured together by the readily detachable tape fastening means as described with respect thereto.

The desk-drawer unit 200 of FIG. 4 utilizes similar slide assemblies to those of unit 20 but the supporting means for the slides is different in the unit 200. To that end, a slide supporting assembly, denoted by the reference numeral 220, is provided and includes a unitary frame member 222 including a pair of vertical legs supporting plural metal "Grant" type slide assemblies 56 thereon. Each slide assembly includes an elongated member 58 and an elongated slide 60. The channel 58 defines a track-like recess therein in which slide 60 is disposed. The slide 60 is adapted to be slide longitudinally along the track formed by the channel member 58.

Each of the drawers 204 and 206 are constructed similar to drawer 24 of unit 20 save for the fact that drawers 205 are larger and drawers 204 are smaller than the drawers 24.

As can be seen in FIG. 6, each side wall 48 of drawer 204 is connected to a respective slide 60 of the slide assembly 56 via plural fastening means, such as screws 62. A spacer or washer 64 is disposed about the shank portion of the screw 62 and between the outer edge of the side wall 48 of the drawer and the slide 60 to space the slide from the drawer's side wall.

The channel member 58 of each slide assembly 56 which is associated with the frame's side wall is mounted horizontally on frame member 222 extending through aligned counter-sunk screws 224 extending through aligned holes in the legs of the frame 222 and in the channel member (See FIG. 5). A frame 222 is in turn adapted to be detachably secured to the inside wall 214 and another frame to the outside wall 208. To that end, as can be seen in FIGS. 5 and 6, the frame 222 includes a normally projecting flange 226 along the bottom thereof. The flange, is adapted to be supported on a horizontally extending cleat 228. Respective clears 228 are permanently secured to the inside surface of each outside wall 208 adjacent the lower edge thereof and respective cleats 228 are also permanently secured to the inside surface of each inside wall 214 adjacent the lower edge thereof. The cleats 228 serve as the means for directly supporting the frame 222 on the associated side wall.

Readily disconnected tape fastening means is provided to secure the frame 222 on the cleat. To that end, strips of one component 74 of the tape fastening means are permanently secured to the under side of flange 226 adjacent each end thereof and strips of the other component 78 of the fastening tape are permanently secured to the upper surface of the clear 228 adjacent the ends thereof. As can be seen in the sectional view of FIG. 6, the upper edges of the frame members 222 are interposed between the tongue and groove of the joints connecting the side wall to the top wall 212. This further secures the frames 222 in place on their associated side walls.

In FIG. 7 there is shown another drawer unit or credenze 300 constructed in accordance with this invention. The credenza 300 is also of a knock-down construction and basically comprises a metal frame 302 for supporting a plurality of drawers 304 and 306 therein. A pair of opposed, vertically oriented, rectangularly shaped side walls 308 are connected to the frame 302 and serve to support the frame slightly above the ground. The frame 302 serves to support directly thereon a rectangularly shaped, horizontally oriented planar top wall 310. In addition, the frame 302 also supports a box-like, hollow bottom wall 311 (FIG. 8).

Figure 8:
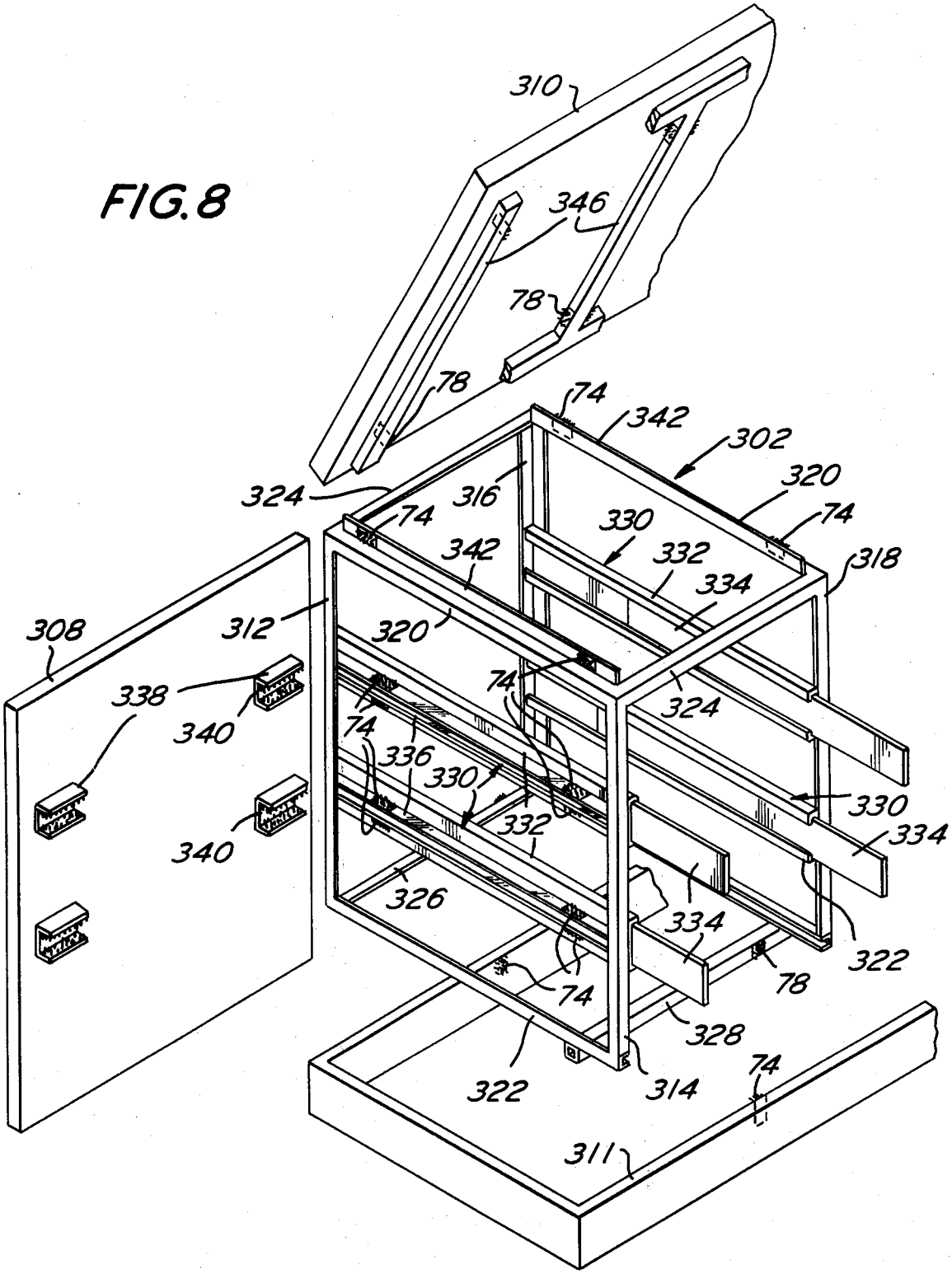
FIG. 8 is an enlarged exploded perspective view of the unit shown in FIG. 7.

As can be seen in FIG. 8, the frame 302 comprises four vertically extending angle bar shaped legs 312, 314, 316 and 318. The upper ends of legs 312 and 314 are connected together via a cross-bar 320, as are the upper ends of legs 316 and 318. The lower ends of legs 312 and 314 are connected by a cross-bar 322, as are the lower ends of legs 316 and 318. The upper ends of legs 312 and 316 and the upper ends of legs 314 and 318 are connected together by respective cross-bars 324. The bottom ends of legs 312 and 316 are connected together by cross-bar 326. A tubular bracing bar 328 serves to connect the cross-bars 322 to each other close to the lower ends of the legs 314 and 318.

The frame 302 serves to support plural slide assemblies 330 thereon. To that end, as can be seen, a pair of "Grant" type slide assemblies are each mounted in a horizontal orientation between the vertical legs 312 and 314 and a similar pair of slide assemblies 330 are similarly mounted between the vertically extending legs 316 and 318.

Each slide assembly 33 is formed of metal and includes an elongated channel member 332 defining a track-like recess therein an in which a slide 334 is disposed. The slide 334 is an elongated member adapted to be slid longitudinally along the track formed by the channel member 332.

Each of the drawers 304 and 306 is of a conventional type and includes a pair of side walls 48, a back wall 50, a base wall (not shown) and a front wall 52. Each drawer is supported by a pair of slide assemblies, one for each side of the drawer, to enable the drawer to be slid out of the unit. To that end, each side wall 48 of the drawer is connected to a respective slide 60 of the slide assembly. Each end of each channel member 58 is permanently secured to an associated vertically extending leg of the frame 302 to support the slide assembly 330 and the drawer connected thereto horizontally on the frame 302.

As can be seen in FIGS. 8 and 9, each channel member 332 includes an elongated support channel bar 336 permanently secured thereto and extending the full length of the channel 332. The support bar 336 serves as the means for connecting the frame 302 to the side walls 308. To that end, plural support means 338 in the form of channel shaped members are mounted on the side walls via their webs. Each channel member 338 defines a space 340 for receiving the support flange 336. The support bar 336 is arranged to be detachably secured to the support means 338 via the use of tape fastening means like that described heretofore. Accordingly, strips of one component 74 of the tape fastening means are permanently secured to the respective top and bottom surfaces of the support bar 336 at the same spacing as that between adjacent support channel members 338. In a similar strips of the other component 78 of the tape are permanently secured to the inner horizontal surfaces of the support channel members 338.

As can be seen in FIG. 8, the height of side walls 308 is greater than the height of the frame 302 such that when the frame 302 is connected to the side wall 308, via the seating of the channel members 336 in their associated supports 338, the frame 302 is held above the ground with the lower edge of the side walls 308 serving as the feet for the credenza (see FIG. 7).

The base wall 311 is mounted below the frame via the use of releasable tape fastening means. To that end, as can be seen in FIG. 8, one component 74 of the tape fastening means is permanently secured to the inside surface of the front and real wall portions of the base wall 312. Strips of the other component 78 of the tape fastening means are permanently secured at corresponding locations on the connector-bars 326 and 328.

The top wall 310 of the credenza is mounted on the frame 302 via a pair of flanges 342 which extend vertically and run along the cross-bars 320. The flanges 342 serve as one component of freely detachable butt joints 344.

The underside of top wall 310 includes elongated members 346 secured thereto and extending parallel to one another from front to back. The spacing between the members 346 is dimensioned so as to permit the spaced flanges 342 of frame 302 to fit therebetween such that the inside face of each member 346 lies immediately adjacent to a corresponding flange 342, thereby forming the butt joints 344.

The joints 344 are secured together via releasable fastening tape. To that end, strips of one component 74 of the tape are permanently secured at spaced locations along the outside surface of each of the flanges 342 of frame 302. Strips of the other component 78 of the tape fastening means are permanently secured to the inside faces of adjacent elongated members 346 at corresponding spaced locations.

It should be pointed out at this juncture that while the drawing and specifications have specifically described three types of drawer containing furniture, it is to be understood that this invention encompasses the construction of all types of furniture having drawers therein, such as chests, credenzas, desks, bureaus, tables, etc.

As should thus be appreciated, the furniture of this invention is simple in construction, can be readily assembled, disassembled and transported, yet once assembled has the look of conventional integrally constructed furniture.

Without further elaboration, the foregoing will so fully illustrate my invention, that others may, by applying current of future knowledge, readily adapt the same for use under various conditions of service.

What is claimed as the invention is:

1. A knock-down drawer unit comprising at least one drawer, a frame for supporting said drawer therein, said frame comprising a vertical side wall and a top wall, said side wall including mounting means having a support bar permanently secured to said side wall, a flange, and a slide assembly permanently connected to said flange and supported on said support bar, said slide assembly slidably supporting said drawer in said frame and comprising an elongated channel member and an elongated slide disposed in said channel member, said flange being disposed on said support bar and releasably secured thereto by a two component releasable fastening tape, one component thereof having a plurality of hook-like elements thereon and the other component thereof having a plurality of loop-like elements thereon, one of said components being permanently secured to said support bar and the other component being permanently secured to said flange, said side wall and top wall of said frame being connected to each other by a freely detachable joint, said joint being secured together by a two component releasable fastening tape, one component thereof having a plurality of hook-like elements thereon and the other component thereof having a plurality of loop-like elements thereon, one of said components being permanently secured to said side wall and the other being permanently secured to said top wall.

2. The device of claim 1 wherein said device comprises a vertical back wall connected to said side wall by a freely detachable joint, said joint being secured together by releasable fastening tape.

3. The device of claim 2 wherein said tape comprises a first and a second component, said first component having a plurality of hook-like elements thereon and the second component having a plurality of loop-like elements thereon.

4. The device of claim 1 wherein said vertical back wall is connected to the top wall at a freely detachable joint, said joint being secured together by releasable fastening tape.

5. The device of claim 4 wherein said tape comprises a first and a second component, said first component having a plurality of hook-like elements thereon and the second component having a plurality of loop-like elements thereon.

6. The device of claim 1 wherein said flange forms a portion of an elongated channel-like member.

7. The device of claim 6 wherein each slide assembly is permanently connected to a respective channel-like member forming said flange.

8. The device of claim 6 additionally comprising a common frame member to which plural slide assemblies are permanently secured, each slide assembly being arranged for slidably supporting as associated drawer, said flange being permanently connected to said common frame member for supporting said member and slide assemblies connected thereto onto said support bar.

* * * * *